US007939238B2

(12) United States Patent
Yamashita et al.

(10) Patent No.: US 7,939,238 B2
(45) Date of Patent: May 10, 2011

(54) DRY TONER AND METHOD OF PREPARING SAME

(75) Inventors: Hiroshi Yamashita, Numazu (JP); Tsunemi Sugiyama, Numazu (JP); Shigeru Emoto, Numazu (JP); Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/370,041

(22) Filed: Feb. 12, 2009

(65) Prior Publication Data

US 2009/0162780 A1 Jun. 25, 2009

Related U.S. Application Data

(62) Division of application No. 10/188,049, filed on Jul. 3, 2002, now abandoned.

(30) Foreign Application Priority Data

Jul. 3, 2001 (JP) ..... 2001-202093

(51) Int. Cl.
*G03G 9/087* (2006.01)

(52) U.S. Cl. ..... 430/137.16; 430/109.4; 430/110.3; 430/137.17; 430/137.19

(58) Field of Classification Search ..... 430/109.4, 430/110.3, 137.15, 137.16, 137.17, 137.19
See application file for complete search history.

(56) References Cited

U.S. PATENT DOCUMENTS

| | | | | |
|---|---|---|---|---|
| 5,047,305 | A * | 9/1991 | Uchida et al. | 430/109.4 |
| 6,077,635 | A | 6/2000 | Okado et al. | |
| 6,338,929 | B1 * | 1/2002 | Hagi et al. | 430/108.4 |
| 6,660,443 | B2 | 12/2003 | Sugiyama et al. | |
| 6,682,866 | B2 | 1/2004 | Sugiyama et al. | |
| 6,800,412 | B2 | 10/2004 | Sugiyama et al. | |
| 7,005,223 | B2 | 2/2006 | Yamashita et al. | |
| 7,056,638 | B1 | 6/2006 | Tomita et al. | |
| 7,157,201 | B2 | 1/2007 | Tomita et al. | |
| 2003/0077536 | A1 | 4/2003 | Yamashita et al. | |

FOREIGN PATENT DOCUMENTS

| | | |
|---|---|---|
| EP | 1 026 554 | 8/2000 |
| EP | 1 093 026 | 4/2001 |
| EP | 1205813 A1 | 5/2002 |
| EP | 1 239 334 | 9/2002 |

OTHER PUBLICATIONS

Patent Abstracts of Japan, JP 56-138743, Oct. 29, 1981.
Grant, R. et al, ed. Grant & Hackh's Chemical Dictionary, Fifth Edition, McGraw-Hill Book Company, NY (1987), p. 138.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A dry toner for developing an electrostatic image, including a toner binder containing a urea-modified polyester. The toner has an average sphericity of 0.96 or more and contains no more than 30% by weight of particles having a sphericity of less than 0.95.

18 Claims, No Drawings

DRY TONER AND METHOD OF PREPARING SAME

BACKGROUND OF THE INVENTION

The present invention relates to a toner for developing an electrostatic image in an image forming method such as electrophotography, electrostatic recording or electrostatic printing and, more particularly, to a dry toner for use in an image forming apparatus, such as a copying machine, a laser printer or a facsimile machine. Moreover, the present invention is also directed to a method of preparing the above toner.

A developer for use in electrophotography, electrostatic recording, electrostatic printing and so on is once adhered to an image carrier such as a photoconductor on which an electrostatic latent image has been formed in a developing process. The toner image thus obtained is then transferred from the photoconductor to a transfer medium such as a transfer paper in a transfer process, and fixed on the paper in a fixing process. As a developer for developing the electrostatic image formed on a latent image holding surface of the image carrier, a two-component developer composed of a carrier and a toner and a one-component developer requiring no carrier (magnetic or nonmagnetic toner) are known.

As a dry toner for use in electrophotography, electrostatic recording, electrostatic printing and so on, a toner obtained by melt-kneading a toner binder such as a styrene resin or a polyester together with a colorant and so on and finely pulverizing the kneaded mixture is conventionally used.

After having been developed and transferred to a paper or the like, such a dry toner is heat-melted and fixed with a heat roll. At this time, when the temperature of the heat roll is excessively high, the toner is excessively melted and adhered to the heat roll (hot offset). When the temperature of the heat roll is excessively low, on the other hand, the toner is not sufficiently melted, resulting in insufficient fixation. With a view to energy saving and downsizing of an apparatus such as a copying machine, a toner which does not cause hot offset at a high fixing temperature (namely, has hot offset resistance) and which can be fixed at a low fixing temperature (namely, has low temperature fixability) is demanded. The toner should also have heat-resistant preservability so as not to cause blocking during storage or under ambient temperature in an apparatus in which the toner is used. Especially, a toner for use in a full-color copying machine and a full-color printer need to have a low melt viscosity to provide gloss and color mixability in a printed image, so that a polyester type toner binder having a sharp melt property is used therein. Since such a toner is likely to cause hot offset, a silicone oil or the like is conventionally applied to a heat roll in full-color machines. However, in order to apply a silicone oil to a heat roll, an oil tank and an oil applying unit are necessary, which makes the apparatus unavoidably complicated and large. Also, application of oil causes deterioration of the heat roll, so that the heat roll requires regular maintenance. Additionally, it is unavoidable for the oil to adhere a copying paper and an OHP (overhead projector) film. Especially, the oil adhered to OHP film impairs color tone of a printed image.

For the purpose of producing an image with high fineness and high quality, improved toners having a small particle size or a narrow particle size distribution have been proposed. However, particles of a toner produced by a normal kneading-pulverizing method have irregular shapes. Thus, the toner particles are further pulverized to generate superfine particles or a fluidizing agent is buried in the surface of the toner particles when the toner is agitated with a carrier in a developing unit or when, in the case of being used as a one-component developer, the toner particles receive a contact stress from a developing roller, a toner supply roller, a layer thickness regulating blade, a frictional electrification blade and so on, resulting in deterioration of image quality. Also, the toner is poor in fluidity as a powder because of the irregular shapes of the particles thereof, and thus requires a large amount of fluidizing agent or cannot be filled in a toner bottle with a high filling rate, which hinders downsizing of the apparatus.

Additionally, a process of transferring an image formed of color toners to produce a full-color image from a photoconductor to a transfer medium or a paper is becoming more complicated, so that low transferability of a pulverized toner due to the irregular shapes of the particles thereof causes a void in a transfer image and an increase in consumption of toners to prevent it.

Thus, there is an increasing demand for reducing toner consumption without causing a void in a transferred image by improving transfer efficiency and for decreasing running cost. When transfer efficiency is significantly high, there is no need for a cleaning unit for removing untransferred toner from a photoconductor and a transfer medium, which leads to downsizing of the apparatus and cost reduction in manufacturing the same. This has also a merit of generating no waste toner. For the purpose of overcoming the drawbacks of the toner of irregular particle shape, there has been proposed various methods for producing spherical toner particles.

For the purpose of providing a toner having heat-resistant preservability, low-temperature fixability and hot offset resistance, there have been proposed (1) a toner in which a polyester partially crosslinked using a multifunctional monomer is used as a toner binder (Japanese Laid-Open Patent Publication No. S57-109825) and (2) a toner in which a urethane-modified polyester is used as a toner binder (Japanese Examined Patent Publication No. H07-101318). For the purpose of providing a toner for use in a full-color system which can reduce the amount of oil to be applied to the heat roll, (3) a toner produced by granulating polyester fine particles and wax fine particles is proposed (Japanese Laid-Open Patent Publication No. H07-56390). Proposed for the purpose of providing a toner having improved powder fluidity and transferability when its particle size is reduced are (4) a polymerized toner obtained by dispersing a vinyl monomer composition containing a colorant, a polar resin and a releasing agent in water and suspension-polymerizing the vinyl monomer composition (Japanese Laid-Open Patent Publication No. H09-43909) and (5) a toner obtained by sphering toner particles comprising a polyester type resin in water using a solvent (Japanese Laid-Open Patent Publication No. H09-34167). Additionally, Japanese Laid-Open Patent Publication No. H11-133666 discloses (6) a dry toner consisting of nearly spherical particles in which a polyester modified with a urea bond is used as a bonder. The toner has a Wadell practical sphericity of 0.90 to 1.00.

However, none of the toners (1) to (3) have sufficient powder fluidity and transferability and thus can produce a high-quality image even when its particle size is reduced. The toners (1) and (2) cannot compatibly satisfy the heat-resistant preservability and the low temperature fixability and do not develop sufficient gloss to be used in a full color system. The toner (3) is insufficient in the low-temperature fixability and the hot offset resistance in oilless fixations. The toners (4) and (5) are improved in the powder fluidity and the transferability. However, the toner (4) is insufficient in the low-temperature fixability and requires much energy to fix. This problem is pronounced when the toner is used in full-color printing. The toner (5), which is superior to the toner (4) in the low-temperature fixability, is insufficient in hot offset resistance and thus cannot preclude the necessity of the application of oil to the heat roll in a full-color system.

The toner (6) is excellent in that the viscoelasticity of the toner can be appropriately adjusted by using a polyester extended by a urea bond and that it can compatibly satisfy both good gloss and good releasing property as a full-color toner. Especially, a phenomenon called "electrostatic offset" in which unfixed toner on a transfer medium is scattered or adhered to a fixing roller due to electrification of the fixing roller during use can be reduced by neutralization of positive charges of the urea bond component with weak negative charges of the polyester resin. However, it has been found that the toner having a Wadell practical sphericity of 0.90 to 1.00 practically contains still causes degradation of image quality.

SUMMARY OF THE INVENTION

It is, therefore, an object of the present invention to provide a dry toner which is excellent in powder fluidity and transferability when its particle size is reduced and in heat-resistant preservability, low-temperature fixability and hot offset resistance.

Another object of the present invention is to provide a dry toner which can produce high gloss and high quality in a printed image and does not require application of oil to a heat roll when used in a full-color copying machine or the like.

It is a further object of the present invention to provide a method of preparing the above dry toner.

As a result of earnest studies for solving the above problems, the present inventors have made the present invention.

In accordance with the present invention, there is provided a dry toner for developing an electrostatic image, comprising a toner binder comprising a urea-modified polyester, said toner having an average sphericity of 0.96 or more and containing no more than 30% by weight of particles having a sphericity of less than 0.95.

In another aspect, the present invention provides a method of producing a toner, comprising the steps of:

dissolving or dispersing a toner composition comprising a urea-modified polyester and a colorant in an organic solvent to prepare a liquid, dispersing said liquid in an aqueous medium to obtain a dispersion containing particles of the toner composition, and removing the solvent from said particles.

The present invention also provides a method of producing a toner, comprising the steps of:

dissolving or dispersing a prepolymer composition comprising an isocyanate-containing polyester-based prepolymer and a colorant in an organic solvent to prepare a liquid, dispersing said liquid in an aqueous medium to obtain a dispersion, subjecting said dispersion to a polyaddition reaction in the presence of an amine to polymerize said prepolymer and to obtain a reaction mixture containing dispersed therein particles of a toner composition comprising the colorant and the polymer obtained from the prepolymer; and removing the solvent from said particles.

Other objects, features and advantages of the present invention will become apparent from the detailed description of the preferred embodiments of the invention to follow.

DETAILED DESCRIPTION OF THE PREFERRED EMBODIMENTS OF THE INVENTION

A dry toner according to the present invention comprises a toner binder including a urea-modified polyester. It is important that the toner should have an average sphericity of 0.96-1.0 and should contain no more than 30% by weight of particles having a sphericity of less than 0.95. When the amount of particles having a sphericity of less than 0.95 exceeds 30% by weight, it is impossible to obtain satisfactory image transfer efficiency and high quality images free of toner dispersion.

The term "average sphericity" as used herein is intended to refer to an average of sphericity defined by the following equation:

$$\text{Sphericity}=\sqrt{4\pi A/B^2}$$

wherein A represents an area of a projected image of a toner particle and B represents a peripheral length of the projected image. The sphericity becomes nearer to 1 as the contour of the particle becomes smoother and the particle becomes more spherical. Sphericity is measured with a flow-type particle image analyzer FPIA-1000 (manufactured by To a Medical Electronics Co., Ltd.). More particularly, 0.1 to 0.5 ml of a surfactant (alkylbenzenesulfonic acid salt) is added to 100 to 150 ml of water, which has been passed through a filter to remove fine dusts. To the water, 0.1 to 0.5 g of a sample is added. This is subjected to a dispersion treatment for 1 to 3 minutes with an ultrasonic disperser to form a sample dispersion liquid having a concentration of 3,000 to 10,000 particles per 1 μL ($10^{-3}$ $cm^3$). The sample dispersion liquid is measured for a particle size distribution and shape of particles using the above flow type particle image analyzer.

It has been found that toner having an average sphericity of 0.96 or more, preferably 0.98-1.0 and a low content (less than 30% by weight, preferably no more than 10% by weight) of particles having sphericity of less than 0.95 can produce very fine and high density images with high reproducibility.

It has been found that the toner disclosed in Japanese Laid-Open Patent Publication No. H11-133666 having a Wadell practical sphericity of 0.90 to 1.00 contains a significant amount of particles having various irregular shapes and causes degradation of image quality.

Although not wishing to be bound by the theory, degradation of image quality due to the presence of irregular shape toner particles is considered to occur as follows. Thus, toner particles having irregular shapes have more points at which they are contacted with a flat surface such as a photoconductor as compared with spherical particles. They have a greater tendency to deposit on the flat surface through van der Waals' force and image force as compared with spherical particles. Further, a developed image of a toner containing both spherical particles and irregular shaped particles has not a stable structure because spherical particles are apt to move during image transfer stage, so that white spots or lack of fine line images are caused. Further, deposition of toner on the photoconductor requires a cleaner or results in a reduction of toner yield.

The toner according to the present invention can give images which are free of white spots, lack of fine line images or image scattering. Further, when the toner is used as a full color toner, clear, high density and high gloss images free of blurs or scattering may be obtained throughout a large number of repeated image production.

The urea-modified polyester may be suitably prepared by reacting an isocyanate-containing polyester prepolymer with an amine. The isocyanate-containing polyester prepolymer may be obtained by reacting a polyisocyanate with a polyester which is prepared by polycondensation of a polyol with a polyacid and which has an active hydrogen. Examples of active hydrogen-containing groups include a hydroxyl group (alcoholic OH or phenolic OH), an amino group, a carboxyl group and a mercapto group.

The polyol may be a diol or a tri- or more polyhydric alcohol. A mixture of a diol with a minor amount of a tri- or more polyhydric alcohol is preferably used.

As the diol to be used for the preparation of the base polyester, any diol employed conventionally for the preparation of polyester resins can be employed. Preferred examples include alkylene glycols such as ethylene glycol, 1,2-propylene glycol, 1,3-propylene glycol, 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol; alkyleneether glycols such as diethylene glycol, triethylene glycol, dipropylene glycol, polyethylene glycol, polypropylene glycol and polytetramethylene ether glycol; alicyclic glycols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2-12 carbon atoms and alkylene oxide adducts of bisphenols are preferred. Especially preferred is the use of a mixture of alkylene glycols having 2-12 carbon atoms with alkylene oxide adducts of bisphenols.

Examples of the polyol having three or more hydroxyl groups include polyhydric aliphatic alcohols such as glycerin, 2-methylpropane triol, trimethylolpropane, trimethylolethane, pentaerythritol, sorbitol and sorbitan; phenol compounds having 3 or more hydroxyl groups such as trisphenol PA, phenol novolak and cresol novolak; and alkylene oxide adducts of the phenol compounds having 3 or more hydroxyl groups.

The polyacid may be a dicarboxylic acid, tri- or more polybasic carboxylic acid or a mixture thereof.

As the dicarboxylic acid to be used for the preparation of the base polyester, any dicarboxylic acid conventionally used for the preparation of a polyester resin can be employed. Preferred examples include alkyldicarboxylic acids such as malonic acid, succinic acid, glutaric acid, adipic acid, azelaic acid and sebacic acid; alkenylene dicarboxylic acids such as maleic acid, fumaric acid, citraconic acid and itaconic acid; and aromatic dicarboxylic acids such as phthalic acid, terephthalic acid, isophthalic acid and naphthalene dicarboxylic acid. Above all, alkenylene dicarboxylic acids having 4-20 carbon atoms and aromatic dicarboxylic acids having 8-20 carbon atoms are preferably used.

Examples of tri- or more polybasic carboxylic acids include aromatic polybasic carboxylic acids having 9-20 carbon atoms such as trimellitic acid and pyromellitic acid.

The polyacids may be in the form of anhydrides or low alkyl esters (e.g. methyl esters, ethyl esters and isopropyl esters).

In the formation of the polyester, the polyacids and the polyols are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Examples of the polyisocyanate compound reacted with the polyester include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as xylylene diisocyanate, tolylene diisocyanate, diphenylmethane diisocyanate and $\alpha, \alpha, \alpha', \alpha'$-tetramethylxylylene diisocyanate; isocyanurates; the above polyisocyanates blocked or protected with phenol derivatives, oximes or caprolactams; and mixtures thereof.

The polyisocyanate is used in such an amount that the ratio [NCO]/[OH] of the equivalent of the isocyanate groups [NCO] to the equivalent of the hydroxyl groups [OH] of the polyester is in the range of generally 5:1 to 1:1, preferably 4:1 to 1.2:1, more preferably 2.5:1 to 1.5:1. A [NCO]/[OH] ratio of over 5:1 tends to adversely affect low temperature fixation properties of the resulting toner. Too small a [NCO]/[OH] ratio of less than 1 tends to adversely affect anti-hot offset properties of the resulting toner.

The isocyanate group-containing polyester prepolymer generally has a content of the polyisocyate unit in the range of 0.5-40% by weight, preferably 1-30% by weight, more preferably 2-20% by weight. Too small an isocyanate group content of less than 0.5% ends to adversely affect anti-hot offset properties and to pose a difficulty in simultaneously obtaining satisfactory low temperature fixation properties and heat-resisting preservability of the resulting toner. When the isocyanate group content exceeds 40% by weight, the low temperature fixation properties of the resulting toner tends to be adversely affected.

The average number of the isocyanate groups contained in the prepolymer molecule is generally at least 1, preferably 1.5-3, more preferably 1.8-2.5. Too small a isocyanate group number less than 1 will result in a urea-modified polyester having an excessively small molecular weight so that the anti-hot offset properties of the toner will be adversely affected.

Examples of the amine to be reacted with the isocyanate group-containing polyester prepolymer for the formation of the urea-modified polyester include diamines, polyamines having 3 or more amino groups, aminoalcohols, aminomercaptans, amino acids and blocked or protected derivatives thereof.

Illustrative of suitable diamines are aromatic diamines such as phenylenediamine, diethyloluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable polyamines having 3 or more amino groups are diethylenetriamine and triethylenetetramine. Illustrative of suitable aminoalcohols are ethanolamine and hydroxyethylaniline. Illustrative of suitable aminomercaptans are aminoethylmercaptan and aminopropylmercaptan. Illustrative of suitable amino acids are aminopropionic acid and aminocaproic acid. Illustrative of suitable blocked derivatives of the above diamines, polyamines having 3 or more amino groups, aminoalcohols, aminomercaptans and amino acids are ketimines obtained by interacting the amines with a ketone such as acetone, methyl ethyl ketone or methyl isobutyl ketone. Oxazolidine compounds may be also used as the blocked derivatives. Especially preferred amine is an aromatic diamine or a mixture of an aromatic diamine with a minor amount of a polyamine having 3 or more amino groups.

If desired, a chain extension terminator may be used to control the molecular weight of the urea-modified polyester. Examples of the chain extension terminators include monoamines such as diethylamine, dibutylamine, butylamine and laurylamine. Blocked or protected monomines such as ketimines may be also used as the terminator.

The amine is reacted with the isocyanate group-containing polyester prepolymer in such an amount that the ratio [NCO]/[$NH_x$] of the equivalent of the isocyanate groups [NCO] of the prepolymer to the equivalent of the amino groups [$NH_x$] of the amine is in the range of generally 1:2 to 2:1, preferably 1.5:1 to 1:1.5, more preferably 1.2:1 to 1:1.2. A [NCO]/[$NH_x$] ratio over 2:1 or less than 1:2 will result in a urea-modified polyester having an excessively small molecular weight so that the anti-hot offset properties of the toner will be adversely affected.

One specific example of a method of producing the urea-modified polyester is as follows. A polyol and a polyacid are reacted with each other in the presence of an esterification catalyst such as tetrabutoxytitanate or dibutyltin oxide at a temperature of 150-280° C. The reaction may be carried out under a reduced pressure while removing water produced in situ, if desired. The resulting hydroxyl group-containing polyester is reacted with a polyisocyanate at 40-140° C. in the presence or absence of a solvent to obtain an isocyanate-containing prepolymer. The prepolymer is reacted with an amine at 0-140° C. in the presence or absence of a solvent to obtain a urea-modified polyester. Any solvent inert to the polyisocyanate may be used. Examples of the solvents include aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

The urea-modified polyester may contain an urethane linkage, if desired. The content of the urethane linkage is generally up to 90 mole %, preferably up to 80 mole %, more preferably up to 70 mole %, based on total of the urethane and urea linkages. Too large an amount of the urethane linkage above 90 mole % may adversely affect the anti-hot offset properties of toner.

The modified polyester used in the present invention may be prepared by one-shot method or a prepolymer method. The modified polyester generally has a weight average molecular weight of at leas: 10,000 preferably 20,000 to $10^7$, more preferably 30,000 to $10^6$. Too small a weight average molecular weight of less than 10,000 may adversely affect the anti-hot offset properties of toner. When the modified polyester is used by itself as the binder, the number average molecular weight thereof is generally 20,000 or less, preferably 1000-10,000, more preferably 2,000-8,000. Too large a number average molecular weight above 20,000 may adversely affect low temperature fixation properties of the resulting toner and gloss of color toner images. When the modified polyester is used in conjunction with a non-modified polyester as the toner binder, however, the number average molecular weight thereof is not specifically limited but may be arbitrarily determined in view of the above weight average molecular weight.

It is preferred that the modified polyester be used in conjunction with a non-modified polyester as the toner binder for reasons of low temperature fixation properties of the toner and improved gloss of the toner images. The non-modified polyester may be polycondensation products obtained from polyols and polyacids. Suitable polyols and polyacids are as described previously with reference to the modified polyester. The amount of the non-modified polyester in the toner binder is such that the weight ratio of the modified polyester to the non-modified polyester is generally 5:95 to 80:20, preferably 5:95 to 30:70, more preferably 5:95 to 25:75, most preferably 7:93 to 20:80. Too small an amount of the modified polyester below 5% by weight is disadvantageous because the anti-hot offset properties are deteriorated and because it is difficult to attain both heat resistive preservability and low temperature fixation properties simultaneously.

The non-modified polyester generally has a peak molecular weight of 1,000 to 30,000, preferably 1,500-10,000, more preferably 2,000-8,000, for reasons of ensuring satisfactory heat-resistant preservability and low temperature fixation efficiency.

The toner binder generally has a hydroxyl value of at least 5, preferably 10-120, more preferably 20-80. Too low a hydroxyl value of less than 5 is disadvantageous to simultaneously attain both good heat resistive preservability and low temperature fixation properties of the toner. The toner binder generally has an acid value of 1-30, preferably 5-20 mg KOH for reasons of improved compatibility between the toner and paper and improved fixing efficiency.

The toner binder used in the present invention generally has a glass transition point of 50-70° C., preferably 55-65° C. A glass transition point of less than 50° C. tends to cause deterioration of heat resistive preservability, while too high a glass transition point of over 70° C. tends to cause deterioration of low temperature fixation properties. Because of the presence of the modified polyester, the dry toner of the present invention exhibits superior heat resistance and preservability even thought the glass transition point of the toner is low.

The toner binder preferably has such a storage elasticity that the temperature (TG') at which the storage elasticity is 10,000 dyne/$cm^2$ at a measurement frequency of 20 Hz is at least 100° C., preferably 110-200° C., for reasons of resistance to hot offset.

The toner binder also preferably has such a viscosity that the temperature (Tη) at which the viscosity is 1,000 poise at a measurement frequency of 20 Hz is 180° C. or less, preferably 90-160° C., for reasons of low temperature fixation efficiency.

Preferably, TG' is higher than Tη from the standpoint of attainment of both low temperature fixation efficiency and resistance to hot offset. In other words, it is preferred that the difference (TG'−Tη) is 0° C. or greater, more preferably at least 10° C., most preferably at least 20° C. The upper limit is not specifically defined. From the standpoint of attainment of both low temperature fixation efficiency and heat resistant preservability, the difference (Tη−Tg) is 0-100° C., more preferably 10-90° C., most preferably 20-80° C.

As the colorant usable for the electrostatic image developing toner of the present invention, any colorant known to be used conventionally for the preparation of a toner can be employed. Suitable colorants for use in the toner of the present invention include known pigments and dyes. These pigments and dyes can be used alone or in combination.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (5G and GR), Permanent Yellow NCG)-, Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B. Brilliant Scarlet G, Lithol Rubine GX Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination. The content of a coloring agent in the toner of the present invention is preferably from about 1-15% by weight, more preferably 3-10% by weight, based on the weight of the toner.

In one embodiment of the production of toner, the colorant is composited with a resin binder to form a master batch.

As the binder resin for forming the master batch, the above-described modified polyester, non-modified polyester may be used. Further, various other polymers may also be used for the formation of the master batch. Specific examples of such other polymers for use in the formation of the master batch include homopolymers of styrene or substituted styrenes such as polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylethyl ether copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These polymers can be used alone or in combination.

The master batch may be obtained by mixing and kneading the binder resin and the colorant while applying a large shear strength thereto using a suitable kneader such as a three-roller mill. In this case, an organic solvent may be used to enhance the interaction between the resin and the colorant. If desired, "flushing" method may be adopted to obtain the master batch. In this method, an aqueous paste containing a colorant is mixed and kneaded together with a binder resin and an organic solvent so that the colorant migrates to the organic phase. The organic solvent and water are then removed.

The toner of the present invention preferably contains a wax as a releasing agent in addition to the toner binder and the colorant. The wax preferably has a melting point of 40-160° C., preferably 50-120° C., more preferably 60-90° C. A melting point of the wax below 40° C. may adversely affect the heat resistance and preservability of the toner, while too high a melting point in excess of 160° C. is apt to cause cold offset of toner when the fixation is performed at a low temperature. Preferably, the wax has a melt viscosity of 5-1000 cps, more preferably 10-100 cps, at a temperature higher by 20° C. than the melting point thereof. When the viscosity is greater than 1000 cps, the anti-hot offset properties and low fixation properties of the toner are adversely affected.

Any wax may be suitably used for the purpose of the present invention. Examples of such wax include polyolefin wax, such as polyethylene wax and polypropylene wax; long chain hydrocarbon wax, such as paraffin wax and sazole wax; and carbonyl group-containing wax.

The carbonyl group-containing wax is preferably used for the purpose of the present invention. Illustrative of suitable carbonyl group-containing waxes are polyalkanoic acid ester waxes such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol ester waxes such as tristearyl trimellitate and distearyl maleate; polyalkanoic acid amide waxes such as ethylenediamine dibehenyl amide; polyalkylamide waxes such as trimellitic acid tristearyl amide; and dialkyl ketone waxes such as distearyl ketone. Above all, the use of a polyalkanoic acid ester wax is preferred.

The amount of the wax in the toner is generally 0-40% by weight, preferably 3-30% by weight, based on the weight of the toner.

The toner of the present invention may contain a charge controlling agent, if desired. Any charge controlling agent generally used in the field of toners for use in electrophotography may be used for the purpose of the present invention. Examples of such charge controlling agents include a nigrosine dye, a triphenylmethane dye, a chromium-containing metal complex dye, a molybdic acid chelates pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metallic salts of salicylic acid and derivatives thereof.

Specific examples of the charge controlling agents include BONTRON 03 (Nigrosine dyes), BONTRON P-51 (Quaternary ammonium salts), BONTRON S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; COPY CHARGE PSY VP2038 (quaternary ammonium salts)' COPY BLUE PR (triphenylmethane derivatives), COPY CHARGE NEG VP2036 (quaternary ammonium salts) and COPY CHARGE NX VP434 (quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

The amount of charge control agent for use in the color toner may be determined in light of the kind of binder resin to be employed, the presence or absence of additives, and the preparation method of the toner including the method of dispersing the composition of the toner. It is preferable that the amount of charge control agent be in the range of 0.1 to 10 parts by weight, and more preferably in the range of 0.2 to 5 parts by weight, per 100 parts by weight of the binder resin. By the addition of the charge control agent in such an amount, sufficient chargeability for use in practice can be imparted to the toner. Further, electrostatic attraction of the toner to a developing roller can be prevented, so that the decrease of fluidity of the developer and the decrease of image density can be prevented.

The charge controlling agent and wax may be mixed and kneaded with the binder resin or the above master batch.

Inorganic fine particles may be suitably used, as an external additive, to improve the fluidity, developing efficiency and chargeability of the toner by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 mμ (5 nm) to 2 μm, more preferably 5 mμ to 500 mμ, and a BET specific surface area of 20-500 $m^2/g$. The inorganic fine particles are used in an amount of generally 0.01-5% by weight, preferably 0.01-2% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents, silicone oil and modified silicone oil.

Cleaning property improving agents may be also used in the toner of the present invention for facilitating the removal of toner remaining on a photoconductor or an intermediate transfer medium after the transference. Examples of such cleaning property improving agents include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The particulate polymer preferably has a volume average particle diameter of 0.01-1 μm.

Dry toner according to the present invention may be prepared, for example, as follows.

First, ingredients of the toner such as a binder including a modified polyester resin, a coloring agent, wax and a charge controlling agent are mechanically mixed with each other using a mixer such as a rotary blade mixer to obtain a mixture.

The mixture is then kneaded using a suitable kneader. A single axis type (or single cylinder type) kneader, a two axis type (or two cylinder type) continuous extruder or a roll mill may be suitably used as the kneader. The kneading should be performed at a temperature near the softening point of the binder resin so as not to cause breakage of the molecular chain of the binder resin. Too high a temperature above the softening point will cause breakage of the molecular chain of the binder resin. The dispersion of the coloring agent, etc. in the binder resin will not sufficiently proceed when the temperature is excessively lower than the softening point.

The kneaded mixture is then solidified and the solidified mixture is grounded, preferably in two, coarsely grinding and succeeding finely grinding stages. The earlier stage may be carried out by impinging the solidified mixture to an impact plate under a jet stream, while the later stage may be performed using a combination of a rotor and a stator with a small gap. The ground mixture is classified in a jet flow utilizing tangential force to obtain a toner having an average size of, for example, 5-20 μm.

The thus obtained toner is, if desired, mixed with an external additive such as a fluidizing agent to improve the fluidity, preservability, developing efficiency and transfer efficiency. The mixing with the external additive may be carried out using a conventional mixer preferably capable of controlling the mixing temperature. The external additive may be added gradually or at once. The rotational speed, mixing time and mixing temperature may be varied in any suitable manner. Illustrative of suitable mixers are V-TYPE mixers, ROCKING mixers, LEDIGE mixers, NAUTER mixers and HENSCHEL mixers.

As methods to obtain spherical toner, there may be mentioned a mechanical methods in which ingredients of the toner such as a binder and a colorant are melt-kneaded, solidified, ground and further processed with a hybridizer or a mechanofusion; a spray dry method in which ingredients of the toner are dispersed in a solution of a toner binder dissolved in a solvent, the dispersion being subsequently spray dried; and a dispersion method in which an organic solvent solution or dispersion containing ingredients of the toner such as a binder resin or a prepolymer thereof and wax is dispersed in an aqueous medium with stirring, preferably while applying shear forces to the wax, to form toner particles which are subsequently separated and dried.

When the dispersion method is adopted, the polar portions of the modified polyester which are compatible with the aqueous medium selectively gather on surfaces of the toner, so that the wax particles are prevented from exposing on the surfaces of the toner. In the thus obtained toner, the wax particles have are finely divided and dispersed in a inside region of the toner, so that toner filming can be prevented and the toner occur can be charged in a stable manner.

The aqueous medium used in the dispersion method may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

The modified polyester used in the dispersion method may be a prepolymer thereof. The prepolymer may be converted into the modified polyester during the dispersing step in the aqueous medium by reaction with, for example, a chain extender or a crosslinking agent. For example, a urea-modified polyester may be produced during the dispersing step in the aqueous medium by reaction of an isocyanate-containing polyester prepolymer with an amine. The reaction may be performed at a temperature of 0-150° C. (under a pressurized condition), preferably 40-98° C., for 10 minutes to 40 hours, preferably 2-24 hours in the presence of, if desired, a catalyst such as dibutyltin laurate or dioctyltin laurate.

The formation of the urea-modified polyester from its prepolymer by reaction with an amine may be carried out either before or after dispersing the prepolymer-containing composition in an aqueous medium. When the reaction with the amine is performed after the prepolymer-containing composition has been dispersed in the aqueous medium, the amine is reacted with the prepolymer on surfaces of the particles.

It is preferred that other ingredients, such as a colorant, a colorant master batch, a wax, a charge controlling agent and a non-modified polyester, than the modified polyester be previously mixed with the modified polyester (or a prepolymer thereof) in an organic solvent. However, at least one of such ingredients may be added to the aqueous medium at the time of dispersing the organic solvent solution of the modified polyester (or a prepolymer thereof) into the aqueous medium or after the formation of toner particles dispersed in the aqueous medium, if desired. For example, the colorant may be incorporated into the toner after the toner particles containing the wax, the binder, etc.

Dispersion into the aqueous phase may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2-20 μm in a facilitated manner. The high speed shearing type dispersing device is generally operated at a revolution speed of 1,000-30,000 rpm, preferably 5,000-20,000 rpm. The dispersing time is generally 0.1 to 5 minutes in the case of a batch type dispersing device. The dispersing step is generally performed at 0-150° C. (under a pressurized condition), preferably 40-98° C. A higher temperature is suitably used to decrease the viscosity of the mass.

The aqueous medium is generally used in an amount of 50-2,000 parts by weight, preferably 100-1,000 parts by weight per 100 parts by weight of the toner composition containing the modified polyester (or a prepolymer thereof) and other ingredients for reasons of obtaining suitable dispersion state.

A dispersing agent may be used in dispersing the toner composition into the aqueous medium to stabilize the dispersion and to obtain sharp particle size distribution. Examples of the dispersing agent include anionic surface active agents such as a salt of alkylbenzensulfonic acid, a salt of α-olefinsulfonic acid and a phosphoric ester; cationic surface active agents such as amine surfactants (e.g. an alkylamine salt, an aminoalcohol fatty acid derivative, a polyamine fatty acid derivative and imidazoline), and quaternary ammonium salt surfactants (alkyl trimethylammonium salt, dialkyl dimethylammonium salt, alkyl dimethylammonium salt, pyridium salt, alkyl isoquinolinium salt and benzethonium chloride; nonthe modified polyester (or a prepolymer thereof) the modified polyester (or a prepolymer thereof); nonionic surface active agent such as a fatty amide derivative and polyhydric alcohol derivative; and ampholytic surface active agents such as alanine, dodecyl di(aminoethyl)glycine and di(octylaminoethyl)glycine and N-alkyl-N,N-dimethylammoniumbetaine.

A surfactant having a fluoroalkyl group can exert its effects in an only very small amount and is preferably used.

Suitable anionic surfactants having a fluoroalkyl group include fluoroalkylcarboxylic acids having from 2-10 carbon atoms and their metal salts, perfluorooctanesulfonylglutamic acid disodium salt, 3-[omega-fluoroalkyl($C_6$-$C_{11}$)oxy]-1-alkyl($C_3$-$C_4$)sulfonic acid sodium salts, 3-[omega-fluoroalkanoyl($C_6$-$C_8$)-N-ethylamino]-1-propanesulfonic acid sodium salts, fluoroalkyl($C_{11}$-$C_{20}$)carboxylic acids and their metal salts, perfluoroalkylcarboxylic acids ($C_7$-$C_{13}$) and their metal salts, perfluoroalkyl($C_4$-$C_{12}$)sulfonic acid and their metal salts, perfluorooctanesulfonic acid diethanolamide, N-propyl-N-(2-hydroxyethyl)perfluorooctanesulfonamide, perfluoroalkyl($C_6$-$C_{10}$) sulfoneamidopropyl trimethylammonium salts, perfluoroalkyl($C_6$-$C_{10}$)-N-ethylsulfonylglycine salts, and monoperfluoroaklyl($C_6$-$C_{16}$)ethylphosphoric acid esters.

Examples of tradenames of anionic surfactants having a perfluoroalkyl group include SURFLON S-111, S-112 and S-113 (manufactured by Asahi Glass Co., Ltd.), FLORARD FC-93, Ec95, FC-98 and FC-129 (manufactured by Sumitomo 3M Ltd.), UNIDINE DS-101 and DS-102 (manufactured by Daikin Co., Ltd.), MEGAFAC F-110, F-120, F-113, F-191, F-812 and F-833 (manufactured by Dainippon Ink and Chemicals, Inc.), EKTOP EF-102, 103, 104, 105, 112, 123A, 123B, 306A, 501, 201 and 204 (manufactured by Tochem Products Co., Ltd.), and PHTHARGENT F-100 and F-150 (manufactured by Neos co., Ltd.).

Examples of suitable cationic surfactants having a fluoroalkyl group include primary, secondary or tertiary aliphatic amine salts; aliphatic quaternary ammonium salts such as perfluoroalkyl($C_6$-$C_{10}$) sulfonamidopropyltrimethyl-ammonium salts; benzalkonium salts; benzethonium chloride; pyridinium salts; and imidazolinium salts. Tradenamed cationic surfactants include SURFLON S-121 (Asahi Glass Co., Ltd.), FLORARD FC-135 (manufactured by Sumitomo 3M Ltd.), UNIDINE DS-202 (manufactured by Daikin Co.), MEGAFAC F-150 and F-824 (Dainippon Ink and chemicals Inc.), EKTOP EF-132 (manufactured by Tochem Products Co., Ltd.), and PHTHARGENT F-300 (manufactured by Neos Co., Ltd.).

In addition, dispersants of inorganic compounds, which are hardly soluble in water, such as tricalcium phosphate, calcium carbonate, titanium oxide, colloidal silica, and hydroxyapatite can also be employed.

In addition, primary particles can be stabilized with polymer type protective colloids. Specific examples of such polymer type protective colloids include homopolymers and copolymers of the following compounds: acids such as acrylic acid, methacrylic acid, α-cyanoacrylic acid, α-cyanomethacrylic acid, itaconic acid, crotonic acid, fumaric acid, maleic acid, and maleic anhydride;

(meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide; vinyl alcohol, ethers such as vinyl methyl ether, vinyl ethyl ether and vinyl propyl ether;

esters of vinyl alcohol with a carboxylic acid such as vinylacetate, vinylpropionate and vinyl butyrate;

amides such as acrylamide, methacrylamide, diacetoneacrylamide, and their methylol compounds;

acid chloride compounds such as acrylic acid chloride, and methacrylic acid chloride;

homopolymers and copolymers of compounds having a nitrogen atom or a heterocyclic ring including a nitrogen atom such as vinyl pyridine, vinyl pyrrolidone, vinyl imidazole and ethylene imine;

polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylene-nonylphenylether, polyoxyethylenelaurylphenylether, polyoxyethylenestearylphenylether, and polyoxyethylene-nonylphenylether; and cellulose compounds such as methyl cellulose, hydroxyethyl cellulose, and hydroxypropyl cellulose.

For the purpose of reducing the viscosity of the prepolymer-containing composition or the urea-modified polyester resin-containing Composition in the dispersion, an organic solvent capable of dissolving the prepolymer or the urea-modified polyester resin may be used. As the organic solvents, there may be mentioned aromatic hydrocarbons such as toluene, xylene and benzene; halogenated hydrocarbons such as carbon tetrachloride, methylene chloride, 1,2-dichloroethane, 1,1,2-trichloroethane, trichloroethylene, chloroform, monochlorobenzene and dichloroethylidene; esters such as methyl acetate and ethyl acetate; and ketones such as methyl ethyl ketone and methyl isobutyl ketone. These solvents may be used singly or in combination. The amount of the organic solvent is generally 0-300 parts by weight, preferably 0-100 parts by weight, more preferably 25-70 parts by weight, per 100 parts by weight of the modified polyester (or a prepolymer thereof). The use of the solvent can produce toner particles having a narrow particle size distribution.

The dispersion or emulsion of toner particles in the aqueous medium thus prepared is then treated to remove the organic solvent. The removal of the organic solvent can be carried out by gradually heating the dispersion to evaporate the organic solvent and also water to dryness, Alternatively, the dispersion is sprayed into a dry atmosphere to evaporate the organic solvent to obtain fine toner particles which are then dried to remove water. The dry atmosphere may be a gas, such as air, nitrogen, carbon dioxide, combustion gas, which is heated above the boiling point of the organic solvent used. A spray drier, a belt drier or a rotary kiln may be used for separating and drying the toner particles.

When a dispersing agent capable of being dissolved in an acid or an alkali is used, washing with an acid or alkali and then with water can remove the dispersing agent from the toner particles. For example, calcium phosphate may be removed by washing with an acid and then with water. An enzyme may be also used to remove certain kinds of the dispersing agent. Although the dispersing agent can be retained on the toner particles, the removal thereof is preferable for reasons of charging characteristics of the toner.

It is preferred that the dispersion or emulsion of toner particles in the aqueous medium prepared above be heat treated at a temperature of at least about 50° C. but not higher than the melting point of the releasing agent (wax) to reduce the irregular size toner particles. The heat treatment is preferably carried out after the removal of the organic solvent but may be conducted before the solvent removing step, if desired. The heat treatment temperature is preferably higher than the softening point of the modified polyester.

When the toner particles in the dispersion obtained have a wide particle size distribution, classification may be conducted. The classification for the removal of excessively fine particles is preferably carried out before separation of the toner particles from the dispersion for reasons of efficiency, though the classification may be preceded by the separation and drying of the particles, Classification for the removal of fine particles may be performed using, for example, a cyclone, a decanter or a centrifugal device. Air classification may be suitably adopted for the removal of large particles after drying of the toner particles. Large and small particles thus separated may be reused as raw materials for the preparation of the toner.

The toner according to the present invention preferably has a volume average particle size of 3 to 10 μm for reasons of obtaining high grade images and good transferability and cleaning efficiency.

The thus obtained toner particles can be mixed with different types of particles such as a particulate release agent, a particulate charge controlling agents a particulate fluidizing agent and a particulate colorant. By applying mechanical force to the mixture, these different particles can be fixed and unified with the surface of the toner particles and thereby the different particles are prevented from releasing from the resultant complex particles. Methods useful for applying mechanical force include impacting the mixture rapidly-rotating blades; and discharging the mixture into a high speed airflow so that the particles of the mixture accelerate and collide with each other or the particles impact against a proper plate or some such object. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

The toner according to the present invention can be used as a two-component developer after mixed with a carrier or as a one-component developer or microtoning developer having magnetic powders incorporated in the toner.

When the toner of the present invention is employed as a two-component developer, any conventionally-known carrier can be used. In this case, the toner is generally used in an amount of 1-10 parts by weight per 100 parts by weight of the carrier. Examples of the carrier include magnetic powders such as iron powders, ferrite powders, magnetite powders, magnetic resin powders and nickel powders and glass beads, anti these powders having a surface treated with a resin. The magnetic toner generally has a particle diameter of 20-200 μm. Examples of the resin for covering the surface of the carrier include amino resins, urea-formaldehyde resins, melamine resins, benzoguanamine resins, urea resins, polyamide resins and epoxy resins. Also usable for covering carrier are polyvinyl or polyvinylidene resins; polystyrene-type resins such as acrylic resins, polymethyl methacrylate resins, polyacrylonitrile resins, polyvinyl acetate resins, polyvinyl fluoride resins; polyvinyl butyral resins, polyvinyl alcohol resins, polystyrene resins and styrene-acrylic acid copolymers; halogenated olefin resins such as polyvinyl chloride resins; polyester resins such as polyethylene terephthalate resins and polybutylene terephthalate resins; polycarbonate resins; polyethylene resins; polyvinylidene fluoride resins; polytrifluoroethylene resins polyhesafluoropropylene resins; copolymers of vinylidene fluoride and acrylic monomer; copolymers of vinylidene fluoride and vinyl fluoride; terpolymers of tetrafluoroethylene, vinylidene fluoride and a fluorine-free monomer; and silicone resins. The resin coating for the carrier may contain conductive powder such as metal powder, carbon black, titanium oxide, tin oxide or zinc oxide. The conductive powder preferably has an average particle diameter of 1 μm or less for reasons of easy control of the electric resistance.

The toner of the present invention may be used as a one-component magnetic or nonmagnetic toner requiring no carrier.

The following examples will further describe the present invention but are not intended to limit the present invention. Parts are by weight. The particle diameter (volume average particle diameter and number average particle diameter) is measured using Coulter counter TA-II or Coulter Multisizer II (manufactured by Coulter Electronics Inc.).

Example 1

Synthesis of Toner Binder:

In a reactor equipped with a condenser, a stirrer and a nitrogen feed pipe, 724 parts of an ethylene oxide (2 mol) adduct of bisphenol A, 276 parts of isophthalic acid and 2 parts of dibutyltin oxide were charged. The mixture was reacted at 230° C. under ambient pressure for 8 hours. The reaction was further continued for 5 hours at a reduced pressure of 10-15 mmHg. The contents in the reactor was then cooled to 160° C., to which 32 parts of phthalic anhydride were added. The resulting mixture was reacted for 2 hours. The polyester-containing mixture thus obtained was cooled to 80° C. and was reacted with 188 parts of isophorone diisocyanate for 2 hours to obtain an isocyanate-containing polyester prepolymer (prepolymer (1)).

The prepolymer (1) (267 parts) was then reacted with isophoronediamine (14 parts) at 50° C. for 2 hours to obtain a urea-modified polyester (urea-modified polyester (1)) having a weight average molecular weight of 64,000.

In the same manner as described above, an ethylene oxide (2 mol) adduct of bisphenol A (724 parts) was reacted with isophthalic acid (276 parts) at 230° C. under ambient pressure for 8 hours. The reaction was further continued for 5 hours at a reduced pressure of 10-15 mmHg to obtain a non-modified polyester (a) having such a molecular weight distribution according to gel permeation chromatography as to provide a main peak at a molecular weight of 5,000.

The above urea-modified polyester (1) (200 parts) and 800 parts of the non-modified polyester (a) were dissolved in 2000 parts of a 1:1 (by weight) mixed solvent of ethyl acetate and methyl ethyl ketone. A part of the solution was then dried in vacuo to obtain a toner binder (toner binder (1))

Preparation of Toner:

240 Parts of the ethyl acetate/MEK solution of the toner binder (1), 20 parts of pentaerythritol tetrabehenate (melting point: 81° C., melt viscosity 25 cps), 4 parts of a copper phthalocyanine blue pigment were charged in a beaker and stirred at 60° C. at 12000 rpm using a TK-type homomixer to dissolve and disperse the mixture uniformly, thereby obtaining a toner composition solution. 706 Parts of ion-exchanged water, 294 parts of a 10% hydroxyapatite suspension (SUPERTITE 10, made by Nippon Chemical Industrial Co., Ltd.) and 0.2 parts of sodium dodecylbenzenesulphonate were charged in a beaker and uniformly dissolved. The solution was heated to 60° C. The toner composition solution was added to the solution with stirring at 12000 rpm with a TK-type homomixer and the stirring was continued for another ten minutes. The mixture was poured into a flask equipped with a stirrer and a thermometer, and heated to 80° C. to remove the organic solvent. Then, hydrochloric acid was added to the mixture to adjust the pH thereof to 2 and to dissolve the hydroxyapatite. The resulting mixture was found to contain a large amount of particles having irregular shapes. Thus, the mixture was heated to 75° C. with stirring and maintained at that temperature for 30 minutes. After have been allowed to cool to room temperature, the mixture was filtered, washed and dried. The thus obtained particles were air-classified, thereby obtaining toner particles having a volume-average particle size of 6.2 μm, an average sphericity of 0.962 and 15.8% by weight of particles having a spherically of 0.95 or less. 100 Parts of the toner particles, 0.5 parts of hydrophobic silica and 0.5 parts of hydrophobized titanium oxide were mixed in a HENSCHEL mixer to obtain toner (1) of the present invention.

Example 2

Synthesis of Toner Binder:

334 Parts of ethylene oxide adduct (2 mol) of bisphenol A, 334 parts propylene oxide adduct (2 mol) of bisphenol A, 274 parts of isophthalic acid and 20 parts of trimelltic anhydride were polycondensed and then reacted with 154 parts of isophorone diisocyanate as in the case of Example 1 to obtain an isocyanate group-containing prepolymer (2). 213 Parts of the prepolymer (2), 9.5 parts of isophrone diamine and 0.5 parts of dibutyl amine were reacted in the same manner as in Example 1, thereby obtaining a urea-modified polyester (2) having a weight-average molecular weight of 79000. 200 Parts of the urea-modified polyester (2) and 800 parts of the unmodified polyester (a) were dissolved and mixed in 2000 parts of a mixed solvent of ethyl acetate/MEK (1/1) to obtain an ethyl acetate/MEK solution of a toner binder (2). A part of the solution was dried under a reduced pressure to isolate the toner binder (2). The isolated toner binder (2) was found to have Tg of 65° C.

Preparation of Toner:

A toner (2) of the present invention was prepared in the same manner as in Example 1 except that the dissolution temperature and the dispersion temperature were changed to 50° C. The toner had a volume average particle diameter (Dv) of 5.2 μm, an average sphericity of 0.985 and 5.8% by weight of particles having a sphericity of 0.95 or less.

Comparative Example 1

Synthesis of Toner Binder:

354 parts of ethylene oxide adduct (2 mol) of bisphenol A, 166 parts of isophthalic acid were polycondensed using 2 parts of dibutyltin oxide as a catalyst to obtain a comparative toner binder (x) having a weight-average molecular weight of 8000.

Preparation of Toner:

100 Parts of the comparative toner binder (x), 200 parts of ethyl acetate solution and 4 parts of a copper phthalocyanine blue pigment were charged in a beaker and stirred at 50° C. at 12000 rpm with a Tk-type homomixer to dissolve and disperse the mixture uniformly, thereby obtaining a toner composition solution. Using the toner composition solution, a comparative toner (1) was obtained in the same manner as in Example 1 except that the solvent removal step was performed at 98° C. with stirring at 800 rpm and that neither the addition of HCl for dissolution of hydroxyapatite nor the succeeding heat treatment was carried out. The microscopic analysis revealed that part of the particles form an aggregate and that the surface thereof was considerably undulated. The toner had a volume average particle diameter (Dv) of 6.3 μm, an average sphericity of 0.935 and 35.2% by weight of particles having a sphericity of 0.95 or less.

Each of the toner (1), toner (2) and comparative toner (1) obtained above was tested for fluidity, gloss, hot offset and image density. The results are summarized in Table 1.

TABLE 1

| Example | Fluidity | Gloss (° C.) | Hot offset (° C.) | Image density (Rank of transfer efficiency) Initial | After 30000 prints |
|---|---|---|---|---|---|
| 1 | 0.40 | 140 | 220 | 1.52 (5) | 1.45 (4) |
| 2 | 0.42 | 150 | above 230 | 1.63 (5) | 1.62 (5) |
| Comp. 1 | 0.35 | 130 | 160 | 1.12 (2) | 0.96 (2) |

Example 3

Preparation of Toner:

A toner (3) was obtained in the same manner as in Example 2 except that 8 parts of carbon black were used as the colorant.

The toner had a volume average particle diameter (Dv) of 5.4 μm, an average sphericity of 0.965 and 24.9% by weight of particles having a sphericity of 0.95 or less.

Example 4

Synthesis of Toner Binder:

363 Parts of ethylene oxide adduct (2 mol) of bisphenol A and 166 parts of isophthalic acid were polycondensed in the same manner as that in Example 1 to obtain a non-modified polyester (b) having such a molecular weight distribution according to gel permeation chromatography as to provide a main peak at a molecular weight of 4,300. The urea-modified polyester (1) (300 parts) obtained in Example 1 and 700 parts of the non-modified polyester (b) were dissolved in 3000 parts of a 1:1 (by weight) mixed solvent of ethyl acetate and methyl ethyl ketone. A part of the solution was then dried in vacuo to obtain a toner binder (4) whose Tg was found to be 57° C.

Preparation of Toner:

Toner (4) was then prepared in the same manner as that in Example 1 except that 300 parts of the ethyl acetate/MEK solution of the toner binder (4) and 8 parts of carbon black were used. The toner (4) had a volume-average particle size of 6.8 μm, an average sphericity of 0.986 and 3.2% by weight of particles having a sphericity of 0.95 or less.

Comparative Example 2

Preparation of Toner Binder:

343 Parts of ethylene oxide adduct (2 mol) of bisphenol A, 166 parts of isophthalic acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours and cooled to 80° C. To the reaction product was added 14 parts of toluene diisocyanate. The mixture was reacted in toluene at 110° C. for 5 hours, followed by removing the solvent, Thereby obtaining a urethane-modified polyester having a wight-average molecular weight of 98000. 363 Parts of ethylene oxide adduct (2 mol) of bisphenol A and 166 parts of isophthalic acid were polycondensed as in the same manner as in Example 1 to obtain an unmodified polyester having a peak molecular weight of 3800, a hydroxyl value of 25, and an acid value of 7. 350 Parts of the above urethane-modified polyester and 650 parts of the above unmodified polyester were dissolved and mixed in toluene. From the solution, the solvent was removed to obtain a comparative toner binder (y) having Tg of 58° C.

Preparation of Toner:

A comparative toner (2) was then prepared using 100 parts of the thus obtained toner binder (y) and 8 parts of carbon black as follows. The binder (y) and carbon black were first mixed with a HENSCHEL mixer and then kneaded with a continuous-type kneader. The kneaded mixture was dried and finely pulverized using a jet-type pulverizer. This was classified using an air jet classifier. 100 Parts of the thus obtained toner particles, 0.5 parts of hydrophobic silica and 0.5 parts of hydrophobized titanium oxide were mixed in a HENSCHEL mixer to obtain the comparative toner (2) having a volume-average particle size of 7.2 μm, an average sphericity of 0.932 and 54.8% by weight of particles having a sphericity of 0.95 or less.

Each of the toner (1), toner (2) and comparative toner (1) obtained above was tested for fluidity, fixing efficiency, hot offset and image density. The results are summarized in Table 2.

TABLE 2

| Example | Fluidity | Fixing efficiency (° C.) | Hot offset (° C.) | Image density (Rank of transfer efficiency) Initial | After 30000 prints |
|---|---|---|---|---|---|
| 3 | 0.40 | 120 | 230 | 1.35 (4) | 1.32 (4) |
| 4 | 0.43 | 120 | above 230 | 1.45 (5) | 1.45 (5) |
| Comp. 2 | 0.29 | 150 | 210 | 1.00 (2) | 0.98 (1) |

Example 5

Preparation Example of Prepolymer:

724 Parts of ethylene oxide adduct (2 mol) of bisphenol A, 250 parts of isophthalic acid, 24 parts of terephthalic acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours while dehydrating and cooled to 160° C. To the reaction product was added 32 parts of phthalic anhydride. The mixture was reacted for two hours and then cooled to 80° C. This was reacted with 188 parts of isophorone diisocyanate in ethyl acetate for 2 hours to obtain an isocyanate group-containing prepolymer (5) having a weight average molecular weight of 12,000.

In the same manner as described above, an ethylene oxide (2 mol) adduct of bisphenol A (724 parts) was reacted with terephthalic acid (276 parts) at 230° C. under ambient pressure for 6 hours. The reaction was further continued for 5 hours at a reduced pressure of 10-15 mmHg to obtain a non-modified polyester (c) having such a molecular weight distribution according to gel permeation chromatography as to provide a main peak at a molecular weight of 6,000.

Preparation Example of Ketimine Compound:

30 Parts of isophorone diamine and 70 parts of methyl ethyl ketone were charged in a reaction vessel equipped with a poker and a thermometer and reacted at 50° C. for 5 hours to obtain a ketimine compound (1).

Preparation Example of Toner:

8.5 Parts of the above prepolymer (5), 64 parts of the non-modified polyester (c) and 78.6 parts of ethyl acetate were charged in a beaker and dissolved by stirring. To the solution were added 20 parts of pentaerythritol tetrabehenate and 4 parts of a copper phthalocyanine blue pigment. This was stirred at 60° C. at 12000 rpm with a TK-type homomixer to dissolve and disperse the mixture uniformly. Finally, 2.7 Parts of the ketimine compound (I) was added and dissolved therein. This was designated as a toner composition solution (1). 706 Parts of ion-exchanged water, 294 parts of a 10% hydroxyapatite suspension (Supertite 10, made by Nippon Chemical Industrial Co., Ltd.), and 0.2 parts of sodium dodecylbenzenesulphonate were charged in a beaker and uniformly dissolved. The solution was heated to 60° C. The toner composition solution (1) was added to the solution with stirring at 12000 rpm with a TK-type homomixer and the stirring was continued for another ten minutes. The mixture was poured into a flask equipped with a stirrer and a thermometer and heated to 80° C. to cause a urea-forming reaction and remove the organic solvent. Then, hydrochloric acid was added to the mixture to adjust the pH thereof to 2 and to dissolve the hydroxyapatite. The resulting mixture was found to contain a large amount of particles having irregular shapes. Thus, the mixture was healed to 75° C. with stirring and maintained at that temperature for 30 minutes. After have been allowed to cool to room temperature, the mixture was filtered, washed and dried. The thus obtained particles were air-classified thereby obtaining toner particles. 100 Parts of the toner particles, 0.5 parts of hydrophobic silica and 0.5 parts of hydrophobized titanium oxide were mixed in a HENSCHEL mixer to obtain a toner (5) of the present invention. The toner had a volume average particle size of 4.5 μm, an average sphericity of 0.995 and 1.2% by weight of particles having a sphericity of 0.95 or less.

Example 6

Synthesis of Prepolymer:

In the same manner as described in Example 1, 669 parts of ethylene oxide adduct (2 mol) of bisphenol A, 274 parts of isophthalic acid and 20 parts of trimellitic anhydride were polycondensed. The mixture was further reacted with 154 parts of isophorone diisocyanate to obtain a prepolymer (6) having a weight average molecular weight of 15,000.

Preparation Example of Toner:

15.5 Parts of the above prepolymer (6), 64 parts of the non-modified polyester (c) and 78.8 parts of ethyl acetate were charged in a beaker and dissolved by stirring. To the solution were added 20 parts of pentaerythritol tetrabehenate and 4 parts of a copper phthalocyanine blue pigment. This was stirred at 50° C. at 12000 rpm with a TK-type homomixer to dissolve and disperse the mixture uniformly. Finally, 2.4 parts of the above ketimine compound (1) and 0.036 part of dibutylamine added and dissolved therein to obtain a toner composition solution (2). Using this solution (2), a toner (6) was prepared in the same manner as that in Example 5 except that the dispersing temperature was 50° C. The toner (6) had a volume average particle size of 5.8 μm, an average sphericity of 0.976 and 8.2% by weight of particles having a sphericity of 0.95 or less.

Comparative Example 3

Synthesis of Toner Binder:

354 parts of ethylene oxide adduct (2 mol) of bisphenol A, 166 parts of terephthalic acid were polycondensed using 2 parts of dibutyltin oxide as a catalyst to obtain a comparative toner binder (z) having a weight-average molecular weight of 12,000.

Preparation of Toner:

100 Parts of the comparative toner binder (z), 200 parts of ethyl acetate solution and 4 parts of a copper phthalocyanine blue pigment were charged in a beaker and stirred at 50° C. at 12000 rpm with a Tk-type homomixer to dissolve and disperse the mixture uniformly, thereby obtaining a toner composition solution. Using the toner composition solution, a comparative toner (3) was obtained in the same manner as in Example 5. The toner had a volume average particle diameter (Dv) of 6.5 μm, an average sphericity of 0.972 and 9.6% by weight of particles having a sphericity of 0.95 or less.

Each of the toner (5), toner (6) and comparative toner (3) obtained above was tested for fluidity, gloss, hot offset and image density. The results are summarized in Table 3.

TABLE 3

| Example | Fluidity | Gloss (° C.) | Hot offset (° C.) | Image density (Rank of transfer efficiency) Initial | After 30000 prints |
|---|---|---|---|---|---|
| 5 | 0.41 | 150 | 230 | 1.58 (5) | 1.62 (5) |

TABLE 3-continued

| Example | Fluidity | Gloss (° C.) | Hot offset (° C.) | Image density (Rank of transfer efficiency) Initial | After 30000 prints |
|---|---|---|---|---|---|
| 6 | 0.42 | 150 | above 230 | 1.45 (4) | 1.43 (5) |
| Comp. 3 | 0.37 | 130 | 160 | 1.10 (4) | 0.85 (1) |

In Tables 1 through 3, fluidity, gloss, hot offset, image density and transfer efficiency were tested in the manner described below.

(1) Fluidity:

Fluidity was evaluated in terms of apparent density, because the fluidity is better as the apparent density increases. The apparent density was measured using a powder tester (manufactured by Hosokawa Micron Co., Ltd.).

(2) Gloss:

Gloss was evaluated in terms of the temperature of a fixing roll of a color copying machine (PRETER 550 manufactured by Ricoh Company, Ltd.) at which gloss-developing temperature An oil supply unit was the 60 degree glossiness of the fixed image was 10% or more. The lower the gloss-developing temperature, the better is the gloss.

(3) Hot Offset:

Occurrence of hot offsetting was determined with naked eyes. Hot offset was evaluated in terms of the temperature of the fixing roll of the above color copying machine at which hot offset occurred. The higher the hot offset-occurring temperature, the better is anti-offsetting property.

(4) Fixing Efficiency:

Copies were produced on papers (TYPE 6200 manufactured by Ricoh Company, Ltd.) using a copying machine (modified) having a fixing roll made of a tetrafluoroethylene resin (MF-200 manufactured by Ricoh Company, Ltd.). The fixing efficiency was evaluated in terms of the minimum temperature of the fixing roll at which the residual rate of the image density was 70% or more when the fixed image was rubbed with a pat. The lower the minimum fixing roll temperature, the better is the fixing efficiency.

(5) Image Density

Each of the toner (5 parts) was mixed with 95 parts of a carrier using a blender for 10 minutes to obtain a two-component developer. The carrier was obtained by coating spherical ferrite particles having an average diameter of 50 μm with a silicon resin, in which an aminosilane coupling agent was dispersed, at an elevated temperature. The silicone resin coating was then cured and cooled to have an average thickness of 0.2 μm. The developer was stirred to have a charge amount of 15 to 25 uc/g (absolute value) which was suitable for obtaining satisfactory developing efficiency while preventing background stains due to toner with reversed charge. The developer was then charged in a color copying machine (PRETER 550 manufactured by Ricoh Company, Ltd.). Copies were produced using papers (TYPE 6000 manufactured by Ricoh Company, Ltd.) with each copy having an image portion whose area accounted for 7% of the total area of the paper. The image densities at different four portions of each of the 10th and 30000th copies were measured with a spectro-densitometer (MODEL X-RITE 938 manufactured by X-Rite Inc.). An average of the four image density values represent the image density.

(6) Transfer Efficiency:

The image obtained in the above image density measurement was evaluated using an optical microscope (magnification; ×100). "Worm eaten" portions in which images were lacking and remained white were counted for evaluation of transfer efficiency according to the following ratings:

5: Excellent
4: Good
3: Fair
2: No good
1: Poor

Toner having excellent transfer efficiency (rank 5) gives images free of worm eaten portions.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2001-202093 filed Jul. 3, 2001, inclusive of the specifications and claims are hereby incorporated by reference herein.

What is claimed is:

1. A method of preparing a toner, comprising:

dissolving or dispersing a prepolymer composition comprising an isocyanate-containing polyester-based prepolymer, a colorant, and a wax in an organic solvent to prepare a liquid, dispersing said liquid in an aqueous medium to obtain a dispersion, polymerizing said prepolymer present in said dispersion by a polyaddition reaction in the presence of an amine to obtain a reaction mixture comprising, dispersed therein, particles of a toner composition comprising the colorant and an urea-modified polyester obtained from the prepolymer;

removing the organic solvent from said particles to obtain toner particles dispersed in an aqueous medium;

heating said toner particles dispersed in the aqueous medium at a temperature of from about 50° C. to the melting point of said wax so that no more than 30% by weight of toner particles have a sphericity of less than 0.95, thereby reducing the irregular shaped toner particles; and filtering, washing and drying the heated toner particles dispersed in the aqueous medium to obtain dried toner particles, wherein said toner has an average sphericity of 0.96 or more;

said toner binder contains an unmodified polyester in addition to the modified polyester, the weight ratio of said modified polyester to said unmodified polyester is in the range of 5:95 to 80:20; and the toner binder has an acid value of 1 to 30 mg KOH/g.

2. The method as claimed in claim 1, wherein said unmodified polyester has such a molecular weight distribution as to provide a main peak at a molecular weight of 1,000 to 30,000.

3. The method as, claimed in claim 1, wherein the toner binder has a glass transition point (Tg) of 50 to 70° C.

4. The method as claimed in claim 1, wherein said toner has an average sphericity of 0.98-1.0.

5. The method as claimed in claim 1, wherein said toner has no more than 10% by weight of particles having sphericity of less than 0.95.

6. The method as claimed in claim 1, wherein the toner binder has a hydroxyl value of at least 5.

7. The method as claimed in claim 1, wherein the toner binder has such a storage elasticity that the temperature (TG') at which the storage elasticity is 10,000 dyne/cm$^2$ at a measurement frequency of 20 Hz is at least 100° C.

8. The method as claimed in claim 1, wherein the toner binder has such a viscosity that the temperature (Tη) at which the viscosity is 1,000 poise at a measurement frequency of 20 Hz is 180° C. or less.

9. The method as claimed in claim 1, wherein the toner binder has such a storage elasticity that the temperature (TG') at which the storage elasticity is 10,000 dyne/cm$^2$ at a measurement frequency of 20 Hz is at least 100° C.;

wherein the toner binder has such a viscosity that the temperature (Tη) at which the viscosity is 1,000 poise at a measurement frequency of 20 Hz is 180° C. or less; and wherein TG' is higher than Tη.

10. The method as claimed in claim 1, wherein polar portions of the urea-modified polyester which are compatible with the aqueous medium selectively gather on a surface of the toner, so that wax, in the form of particles, is finely divided and dispersed within the toner are prevented from exposing on the surface of the toner.

11. The method as claimed in claim 1, wherein the toner has a volume average particle size of 3 to 10 μm.

12. The method as claimed in claim 1, wherein said wax has a melting point of from 40-160° C.

13. The method as claimed in claim 1, wherein said wax has a melting point of from 50-120° C.

14. The method as claimed in claim 1, wherein said wax has a melting point of from 60-90° C.

15. The method as claimed in claim 1, further comprising attaching inorganic fine particles selected from the group consisting of silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride to outer surfaces of said dried toner particles, wherein said inorganic fine particles are present in an amount of from 0.01 to 5% by weight, based on the weight of the toner.

16. The method as claimed in claim 1, wherein said dispersing comprises adding a surfactant having a fluoroalkyl group to the aqueous medium.

17. The method as claimed in claim 16, wherein said surfactant having a fluoroalkyl group is an anionic surfactant selected from the group consisting of:

perfluorooctanesulfonylglutamic acid disodium salt;

a 3-[omega-fluoroalkyl($C_6$-$C_{11}$)oxy]-1-alkyl($C_3$-$C_4$)sulfonic acid sodium salt;

a 3-[omega-fluoroalkanoyl($C_6$-$C_8$)-N-ethylamino]-1-propanesulfonic acid sodium salt;

a fluoroalkyl($C_{11}$-$C_{20}$)carboxylic acid;

a metal salt of a fluoroalkyl($C_{11}$-$C_{20}$)carboxylic acid;

a perfluoroalkylcarboxylic acid ($C_7$-$C_{13}$);

a metal salt of a perfluoroalkylcarboxylic acid ($C_7$-$C_{13}$);

a perfluoroalkyl($C_4$-$C_{12}$)sulfonic acid;

a metal salt of a perfluoroalkyl($C_4$-$C_{12}$)sulfonic acid;

perfluorooctanesulfonic acid diethanolamide;

N-propyl-N-(2-hydroxyethyl)perfluorooctanesulfonamide;

a perfluoroalkyl($C_6$-$C_{10}$) sulfoneamidopropyl trimethylammonium salt;

a perfluoroalkyl($C_6$-$C_{10}$)-N-ethylsulfonylglycine salt; and a monoperfluoroaklyl($C_6$-$C_{16}$)ethylphosphoric acid ester.

18. The method as claimed in claim 16, wherein said surfactant having a fluoroalkyl group is a perfluoroalkyl($C_6$-$C_{10}$) sulfonamidopropyltrimethyl-ammonium salt as a cationic surfactant.

* * * * *